US005127124A

United States Patent [19]

Palmer et al.

[11] Patent Number: 5,127,124

[45] Date of Patent: Jul. 7, 1992

[54] ADJUSTABLE SUSPENSION FOR HIGH SPEED PAD DRIVER

[75] Inventors: Gary E. Palmer, Roselle; Alexander Buziuk, Schiller Park; Rick McLeod, Lake In The Hills; Ronald J. Smith, Carol Stream, all of Ill.

[73] Assignee: Hako Minuteman, Inc., Addison, Ill.

[21] Appl. No.: 667,637

[22] Filed: Mar. 11, 1991

[51] Int. Cl.[5] ..... A47L 11/14

[52] U.S. Cl. ..... 15/98; 15/49.1; 51/177

[58] Field of Search ..... 15/98, 49.1, 50.1, 385, 15/87, 180; 51/177

[56] References Cited

U.S. PATENT DOCUMENTS 4,365,377 12/1982 Todd et al. ..... 15/98
4,731,895 3/1988 Zack et al. ..... 15/98
4,888,843 12/1989 Smith et al. ..... 15/98

*Primary Examiner*—Edward L. Roberts
*Attorney, Agent, or Firm*—Emrich & Dithmar

[57] ABSTRACT

Apparatus for adjusting the height above the floor of a plate to which is attached a pad in a rotary floor machine to accommodate pads having a range of thicknesses includes a yoke disposed about the generally vertical support shaft of a caster positioned within a centrally-located aperture in the pad in contact with the floor. The yoke is also disposed about and supports a rotational drive arrangement coupled to the plate and includes a ring bearing to facilitate rotational displacement of the drive arrangement within the yoke. One end of the yoke is pivotally coupled to the machine's housing, while a manually adjustable coupler attaches a second, opposed end of the yoke to the housing to permit raising and lowering of the yoke in a pivoting manner. Disposed within the yoke and engaging the rotational drive arrangement is a gimbal-like suspension arrangement which maintains the drive arrangement vertical (perpendicular to the floor) and the pad plate horizontal as the yoke is pivotally raised and lowered to accommodate pads having a range of thicknesses. By maintaining the pad plate horizontal regardless of its height above the floor, uniform contact with the floor over the entire lower surface of the pad is ensured.

17 Claims, 4 Drawing Sheets

ADJUSTABLE SUSPENSION FOR HIGH SPEED PAD DRIVER

FIELD OF THE INVENTION

This invention relates generally to high speed rotary floor machines, such as burnishers, and is particularly directed to a suspension arrangement for a rotary pad driver assembly in such an apparatus which maintains the entire lower surface of the pad in uniform contact with the floor during operation.

BACKGROUND OF THE INVENTION

Rotary floor machines generally include a handle for operator control of the machine, a machine housing having wheels for mobility, and a pad mounted in the housing for circular rotation about a generally vertical axis. The machine is used in floor care and maintenance, with the pad used for buffing, burnishing, polishing, scrubbing, or other floor care operations. The pad is generally comprised of a loosely entwined synthetic material, such as polyester, and is subject to wear and replacement.

Machines of this type are generally supported by a pair of aft wheels to allow the machine to be easily displaced during operation and transported between jobs. In addition, there may also be a center caster disposed in a center aperture in the pad about which the pad rotates. The center caster maintains the machine housing above the floor, with the pad disposed in contact with the floor and immediately beneath the housing. Pad thickness varies widely among the various suppliers from ¾ to 1½ inches. Structural constraints and design limitations in the pad suspension and drive system have prevented current rotary floor care machines from accommodating this range of pad variation.

The triangular support arrangement of rotary floor care machines described above gives rise to another problem when pads of various thickness are employed. If the center caster is raised, the front of the pad is displaced upwardly and the rear of the pad downwardly causing uneven action between the pad and the floor. The tilted orientation of the pad results in a greater contact area with the floor toward the rear of the pad and a reduced contact area toward the front of the pad. The pad wears unevenly, reducing its useful life. This situation gives rise to another, more serious problem. For example, when the pad mounting and drive mechanism is raised to accommodate increased pad thickness, the inclined orientation of the pad securing mechanism results in reduced pad contact with the floor at the front of the machine even to the point where there may be no contact, while the rear of the pad is forced against the floor with increased pressure. This increased pressure may result in damage to the floor. Moreover, as the pad is rotated through a full revolution at the typically high operating speeds of such machines, i.e., on the order of 2000 RPM, the pad is highly compressed at the six o'clock position, i.e., nearest to the operator, and may not be compressed at all at the twelve o'clock position. At the two intermediate positions the pad material will be exposed to an intermediate pressure as it is compressed between the backing plate and the floor. As the pad is rotated at these high speeds and undergoes a large number of cycles of pinching and releasing, the pad tends to become free of the backing plate teeth which hold it in place. This is due to the non-woven structural nature of the pad itself and the manner in which it is secured to the backing plate of the pad assembly.

Referring to FIGS. 1 and 2, there is shown a partially cutaway side elevational view of a rotary floor machine 80 illustrating the nonuniform pad-floor engagement encountered in the prior art. The rotary floor machine 80 includes a pair of main support wheels 82 (only one of which is shown in the figure for simplicity) and a center caster 84. The center caster 84 is positioned within an aperture in the machine's rotary pad 88. Means are provided (although not shown in the figure for simplicity) to adjust the position of the caster 84 relative to the machine's housing 86. Thus, the housing 86 and pad 88 may be raised or lowered relative to the floor by adjusting the position of the caster 84 within the housing. The housing 86 pivots upward or downward about a pivot axis 90 aligned with the two main support wheels 82. Because the pad 88 is displaced about the pivot axis 90 and does not move in a true vertical direction as the height of the caster 84 is changed, a nonparallel alignment results between the pad and the floor. For example, when the caster 84 is extended from the housing 86 so as to raise the pad relative to the floor, the leading lower edge of the pad may be positioned above the floor as shown by the distance "X" in FIG. 1. Similarly, where the caster 84 is retracted into the housing 86 for the purpose of lowering the pad 88 relative to the floor, a gap "Y" may be formed between the aft, lower edge of the pad and the floor as shown in FIG. 2. In either case, uneven pad wear results and a poor burnishing is achieved because of the unevenness in applied pad pressure.

One attempt to solve the problem of irregular pad wear and floor damage caused by the use of pads of varying thickness in a three-wheeled rotary floor care machine is disclosed in U.S. Pat. No. 4,365,377. In this approach, a caster disposed within a centrally-located aperture in the pad is increasingly urged away from the housing of the machine as the caster and housing progressively approach one another with increasing compression of the pad. As the pad mounting arrangement is caused to be moved downwardly compressing a portion of the pad, the compression means, such as a coiled spring, exerts progressively increasing force upon the pad suspension arrangement to increasingly urge it back upwardly to a position wherein the pad is not compressed. This approach also suffers from pad "tilt" from front to back inherent in a triangular support arrangement.

Another common source of misalignment out of the horizontal in this type of support arrangement is caused by wheels of different diameter. Commercially available wheels used in rotary floor care machines are not precisely dimensioned and may vary considerably in diameter. This too gives rise to pad carrier misalignment and irregular and excessive pad wear.

OBJECTS AND SUMMARY OF THE INVENTION

Accordingly, it is an object of the present invention to provide an improved suspension for a floor-working pad in a high speed rotary floor machine.

Another object of the present invention is to provide a pad mounting and suspension system in a high speed rotary floor care machine capable of accommodating a range of pad thicknesses without diminishing machine operation and performance.

Yet another object of the present invention is to maintain uniform contact between a rotary pad and the floor over the entire lower surface of the pad in a high speed rotary floor care machine for pads having a wide range of thicknesses.

A further object of the present invention is to essentially eliminate uneven pad wear and edge scouring in a high speed rotary floor care machine by suspending the pad and its mounting plate in a gimbal-like arrangement which maintains the pad's axis of rotation perpendicular to the floor.

This invention contemplates apparatus for use in a high speed rotary floor machine including a housing having a plurality of wheels, a drive motor and pulley arrangement for rotationally displacing a compressible, circular pad attached to a mounting plate and having a center aperture, and a caster disposed in the center aperture of the pad in contact with the floor and pivotally coupled to the housing by means of a generally vertical, fixed shaft, wherein the mounting plate is coupled to and suspended from the pulley arrangement. The inventive apparatus positions the mounting plate over a range of heights above the floor to accommodate a range of pad thicknesses and comprises: a yoke disposed about and engaging the pulley arrangement, the yoke including a bearing for facilitating rotational displacement of the pulley arrangement in the yoke; a first coupling arrangement for pivotally coupling a first portion of the yoke to the housing; a second adjustable coupling arrangement for coupling a second, opposed portion of the yoke to the housing and allowing for raising and lowering of the second, opposed portion of the yoke and pivoting displacement of the first portion of the yoke in changing the height of the pulley arrangement and mounting plate above the floor in accordance with the thickness of the pad; and an alignment assembly within the yoke disposed about the generally vertical, fixed shaft and engaging the pulley arrangement for maintaining the mounting plate and pad parallel to the floor as the height of the mounting plate above the floor is changed to maintain the pad in uniform contact with the floor over its entire lower surface.

BRIEF DESCRIPTION OF THE DRAWINGS

The appended claims set forth those novel features which characterize the invention. However, the invention itself, as well as further objects and advantages thereof, will best be understood by reference to the following detailed description of a preferred embodiment taken in conjunction with the accompanying drawings, where like reference characters identify like elements throughout the various figures, in which:

DETAILED DESCRIPTION OF THE PREFERRED EMBODIMENT

Figure 1:
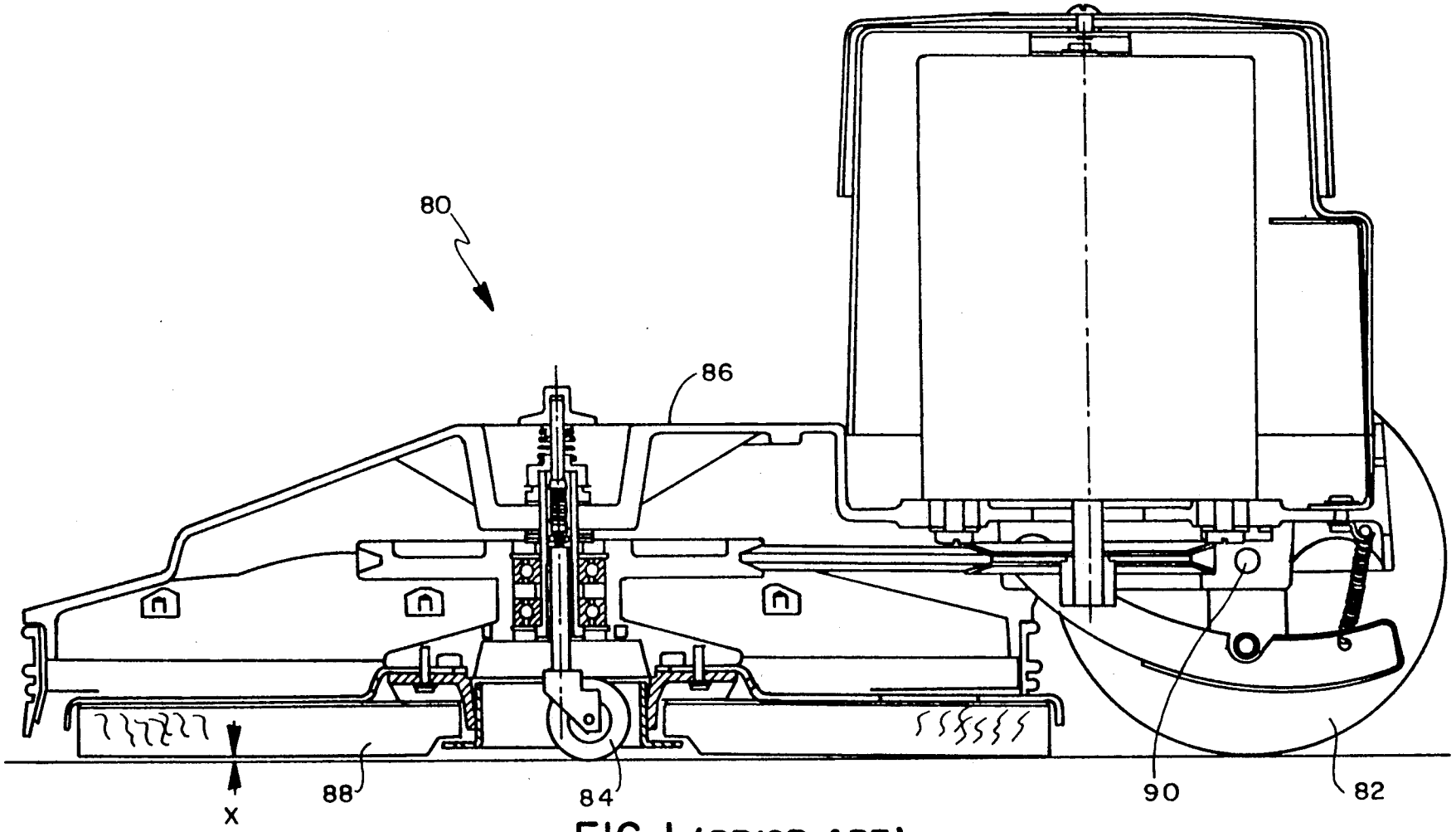
FIG. 1 (PRIOR ART)
FIGS. 1 and 2 are side elevation views shown partially cutaway of a high speed rotary floor machine illustrating two examples of nonuniform pad engagement with the floor experienced in prior art machines.
Figure 2:
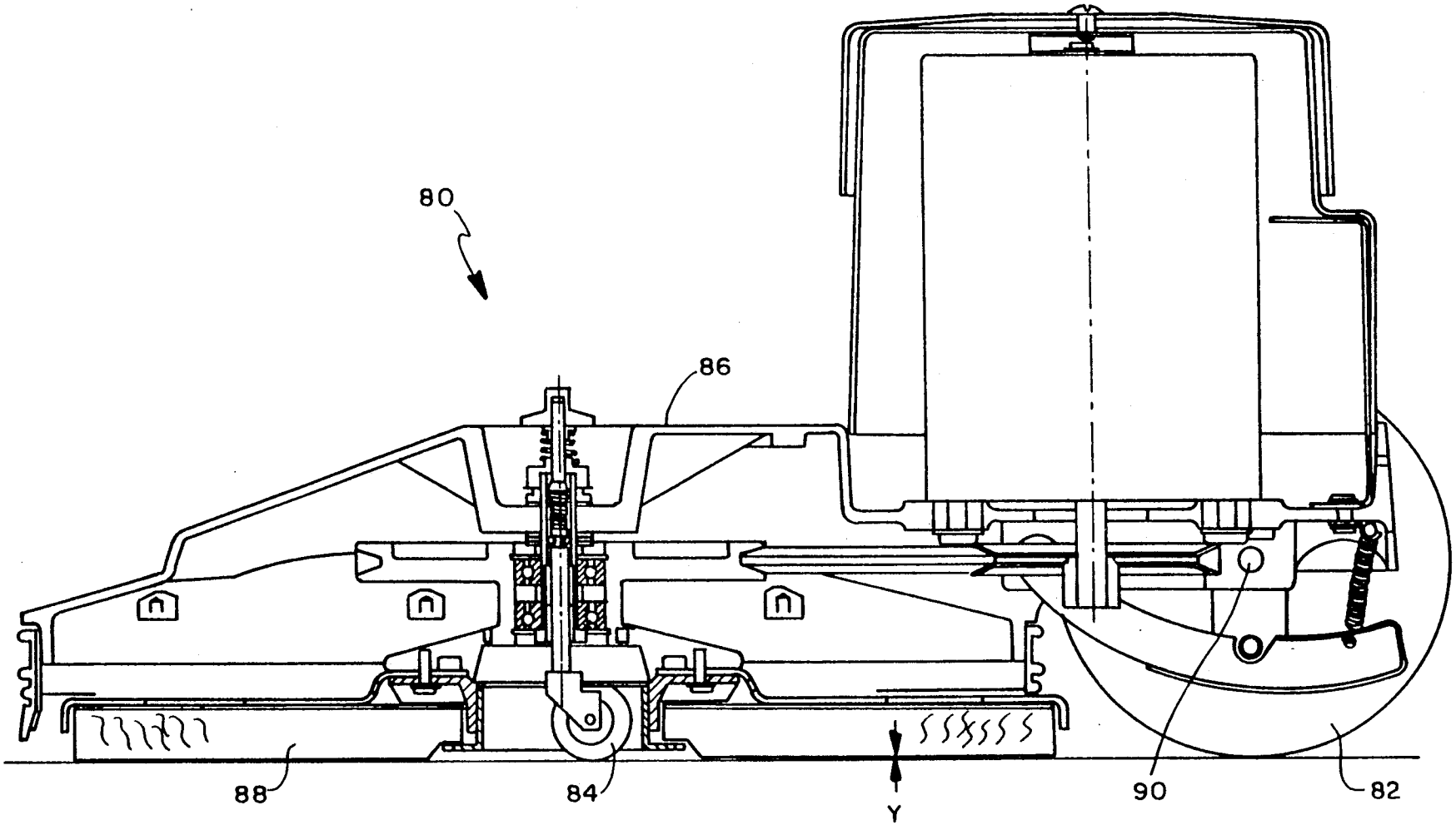
FIG.2 (PRIOR ART)
Figure 3:
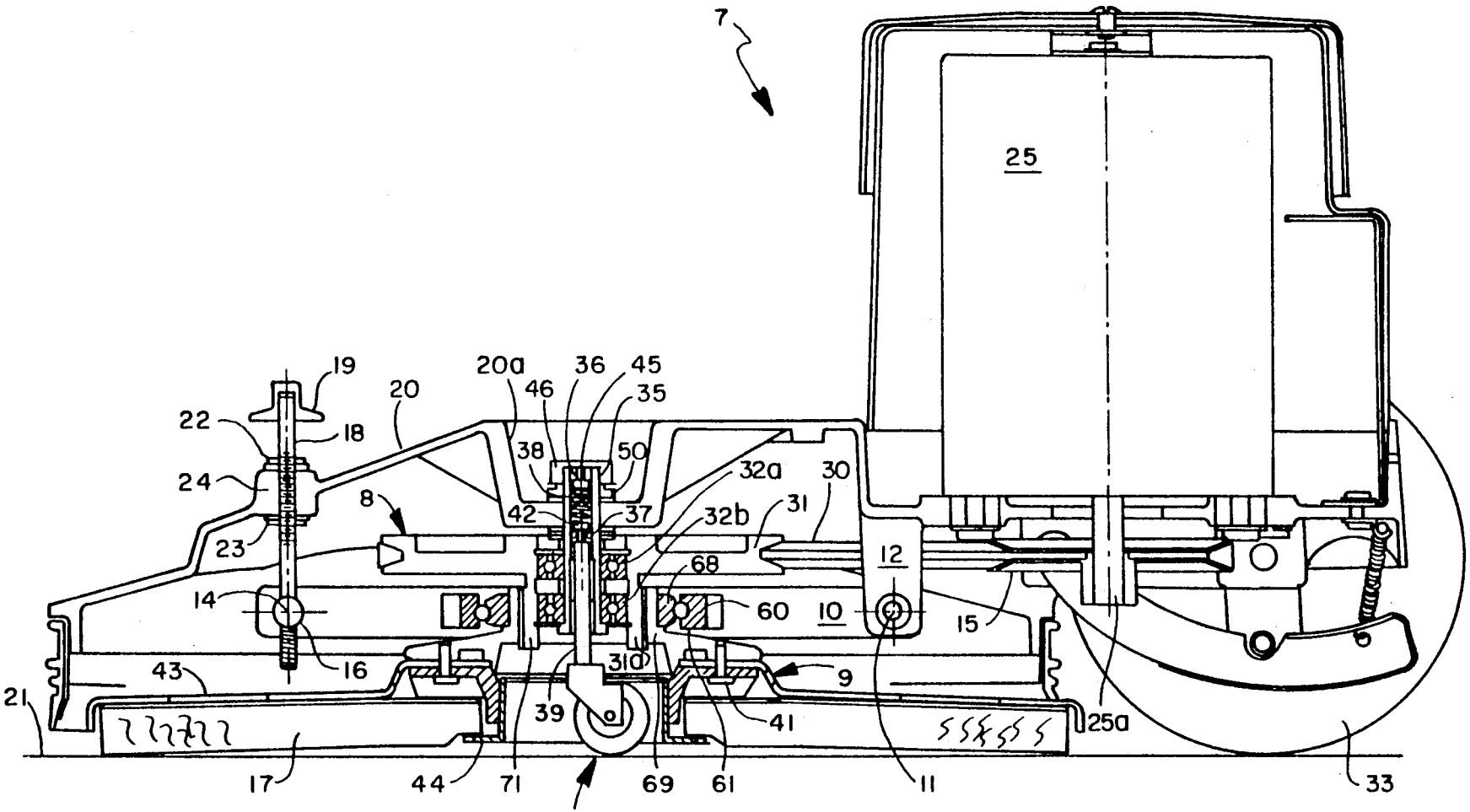
FIG. 3 is a simplified side sectional view of a rotary floor machine incorporating an adjustable suspension arrangement for a pad driver assembly in accordance with the present invention.

Referring to FIG. 3, there is shown a side sectional view of a portion of a rotary floor machine 7 incorporating an adjustable suspension system 8 for use with a high speed pad driver 9. The rotary floor machine 7 includes a pair of main support wheels 33 (only one of which is shown in the figure for simplicity) and a pivoting center caster 40. These wheels provide support for the rotary floor machine 7 and allow it to be displaced over a generally flat surface, such as a floor, 21. The rotary floor machine 7 also typically includes a handle (which is also not shown for simplicity) to facilitate operation and displacement of the machine. A drive motor 25 disposed with a housing 20 includes a drive shaft 25*a* extending therefrom which is coupled to and rotationally displaces a drive belt 30 by means of a first drive pulley 15. The drive belt 30 is, in turn, coupled to and rotationally displaces a second drive pulley 31. The housing 20 covers the drive motor 25 as well as the adjustable suspension system 8 and high speed pad driver arrangement 9. A pad 17 is positioned adjacent to a lower portion of the housing 20 and is rotationally displaced at high speed by means of a combination of the drive motor 25 and high speed pad driver 9 as described in the following paragraphs.

The housing 20 includes a recessed, upper portion 20*a* having an aperture therein through which is inserted an elongated, linear hollow tube 35. The hollow tube 35 is maintained in position in the aperture within the recessed portion 20*a* of the housing 20 by means of a nut 50 disposed about the hollow tube and engaging an upper surface of the housing 20 . A metal cap 46 is securely positioned upon the open upper end of the hollow tube 35 in a snap-acting manner or by means of threaded engagement. Inserted in the hollow tube 35 in the open lower end thereof is a support shaft 39 coupled to and extending upward from the caster 40. An upper end of the support shaft 39 includes a bolt 42 engaging a lower end of a coiled spring 38 disposed about a threaded shaft 45. With the coiled spring 38 positioned between and in contact with the upper end of bolt 42 and a nut attached to an upper end of the threaded shaft 45, the coiled spring urges the support shaft 39 and caster 40 combination downward. Upper and lower thrust bearings 36 and 37 disposed about the threaded shaft 45 and bolt 42 facilitate rotational displacement of the support shaft 39 within the fixed hollow tube 35. Caster 40 is thus free to rotate 360° about a generally vertical axis coincident with support shaft 39 and is also free to move upwardly upon engagement with an obstruction on the floor 21 by compressing coiled spring 38. Cap 46 securely attached to the upper end of the hollow tube 35 maintains the various aforementioned components within the tube.

The second drive pulley 31 is disposed about and coupled to the hollow tube 35 by means of upper and lower bearings 32*a* and 32*b*. Bearings 32*a*, 32*b* allow the second drive pulley 31 to rotate about the fixed hollow tube 35. Disposed about the caster 40 and coupled to a lower portion 31*a* of the second drive pulley 31 is a casting 69. Casting 69 also includes a center aperture through which is inserted and in which is positioned the caster support shaft 39. A spline connection 71 securely couples the lower portion 31*a* of the second drive pulley 31 to the casting 69. Details of the drive pulley portion of the spline connection 71 can be seen in FIG.

4, which is a bottom plan view of the adjustable suspension system 8. The spline connection 71 between the second drive pulley 31 and the casting 69 ensures that these two components rotate together. An enlarged, lower portion of the hollow tube 35 maintains the upper and lower bearings 32*a* and 32*b* in position on the tube.

Attached to the casting 69 by means of a plurality of threaded pins 41 is a generally circular mounting plate 43 having an aperture in the center thereof. The pad 17 is securely attached to a lower surface of the mounting plate 43 by conventional means such as a combination of pad engaging teeth (not shown) and pad holding tabs 44.

Also disposed about and engaging the high speed pad driver 9 is a yoke 10. A first end of the yoke 10 is pivotally coupled to a mounting bracket 12 in the rotary floor machine 7. Conventional means such as a pivot pin and pair of aligned apertures may be used to form the pivot connection 11 between the yoke 10 and the frame of the rotary floor machine 7. A second end of the yoke 10 is coupled to the machine frame 20 by means of an externally threaded adjustment bolt 18. A lower threaded portion of the adjustment bolt 18 engages an internally threaded pin securely coupled to the first and second bars 10*a*, 10*b* at the second end of the yoke 10. Threaded adjustment bolt 18 is securely maintained in a fixed position within the housing 20 by means of upper and lower retaining pins 22 and 23 inserted through the adjustment bolt on respective sides of the housing. Attached to the upper end of the threaded adjustment bolt 18 is a knob to facilitate manual rotation of the threaded adjustment bolt 18. Rotational displacement of the adjustment bolt 18 in a first direction causes the second, or forward, end of the yoke 10 to be displaced upward. Rotational displacement of the adjustment bolt 18 in the opposite direction causes the yoke 10 to be pivotally displaced downward about pivot connection 11. In this manner, the yoke 10 as well as the pad driver 9 attached thereto may be moved upward and downward to adjust for the thickness of pad 17.

Figure 4:
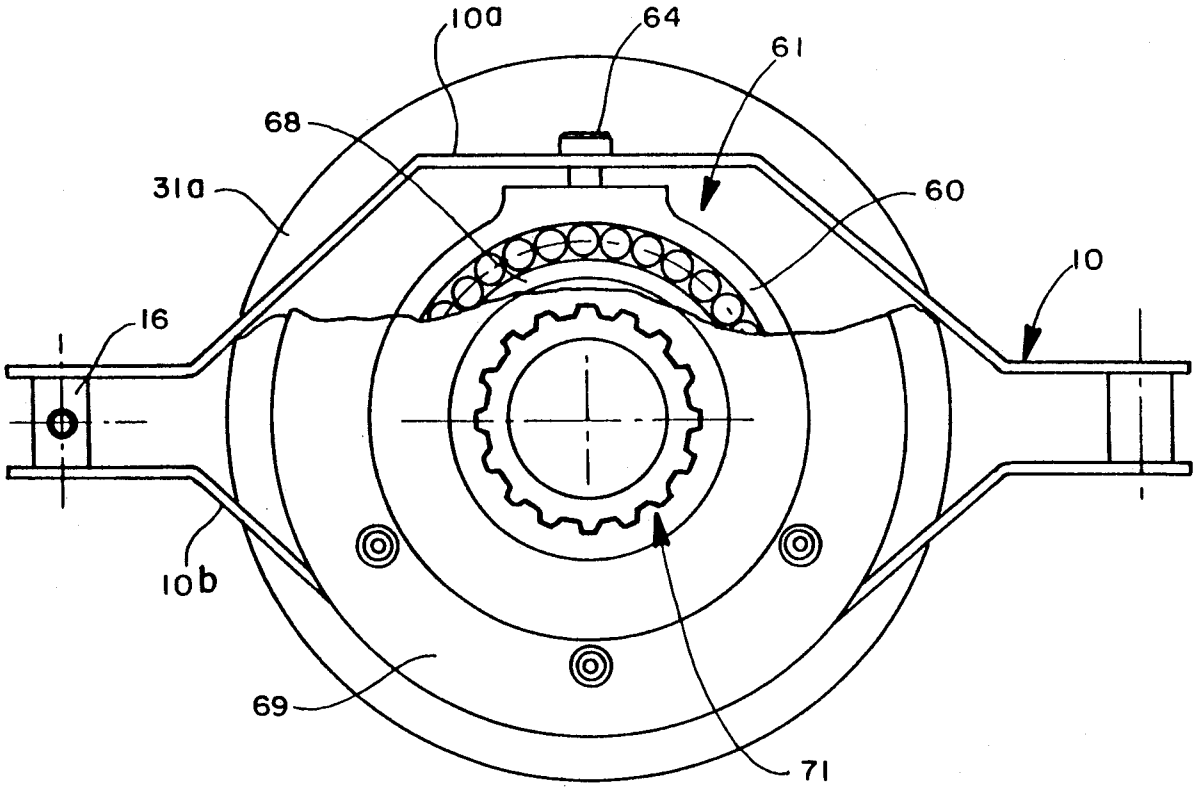
FIG. 4 is a bottom view shown partially cutaway of the yoke portion of the adjustable suspension arrangement shown in FIG. 3.

Additional details of the yoke 10 can be seen in FIG. 4. The yoke 10 includes a pair of spaced, aligned bars 10*a* and 10*b*. The bars 10*a*, 10*b* are bent so as to form an enlarged space between intermediate portions of the bars. The outer race 60 of a ring bearing 61 is coupled by means of a pair of shoulder bolts 64 to the yoke bars 10*a* and 10*b*, although only one shoulder bolt is shown in the figure for simplicity. The ring bearing 61 includes an outer race 60 and an inner race 68. The ring bearing 61 is free to rotate about the axis of the shoulder bolt 64. The spline connection 71 disposed on a lower portion of the second drive pulley 31 is also shown in FIG. 4.

As shown in FIG. 3, the inner race 68 of the ring bearing 61 engages an outer, upper portion of casting 69. The outer race 60 is coupled to the yoke 10. The combination of the second drive pulley 31 and casting 69 is thus free to rotate within, while being supported by, the yoke 10.

The adjustable suspension system 8 which primarily includes the ring bearing 61 pivotally coupled to the yoke 10 allows the pad driver 9 to remain generally vertical as the yoke 10 is pivotally displaced about pivot connection 11. The pivoting displacement of the ring bearing 61 as the yoke 10 is pivotally displaced permits the combination of the second drive pulley 31 and casting 69 to remain generally vertical. With the mounting plate 43 securely attached to a lower portion of casting 69, a vertical orientation of the casting ensures a generally horizontal orientation for the mounting plate 43 ensuring that the pad 17 is parallel to the floor 21. In this manner, the lower surface of the pad is maintained in substantially uniform contact and under uniform pressure over its entire lower surface with the floor 21. The combination of the ring bearing 61 and yoke 10 forms a gimbal-like structure to permit the high speed pad driver 9 which includes the second drive pulley 31 and casting 69 to be suspended in a generally vertical orientation throughout the pivoting displacement of the yoke 10.

Figure 5:
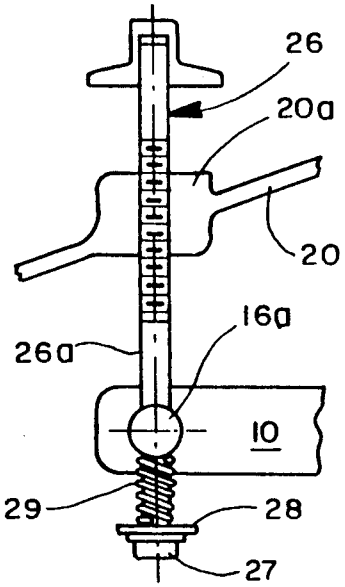
FIG. 5 is a detailed view of a second embodiment of a manual adjustment arrangement for adjusting the height of the pad suspension system above the floor to accommodate a range of pad thicknesses.

Referring to FIG. 5, there is shown an alternative embodiment for manually adjusting the height of the mounting plate 43 above the floor 21 to accommodate a range of pad thicknesses. In the arrangement of FIG. 5, a threaded bolt 26 is inserted through and coupled to a threaded boss 20*a* formed in housing 20. The bolt 26 includes a lower, non-threaded portion 26*a* inserted through a pin 16*a* which is securely coupled to the yoke 10. Attached to a lower end of the threaded bolt 26 is a combination of a washer 28 and cap 27. Disposed between the pin 16*a* and washer 28 is a coiled spring 29 which is disposed about the lower end of the threaded bolt 26. Rotation of the threaded bolt 26 causes upward or downward displacement of the forward portion of the yoke 10 in a manner previously described. Coiled spring 29 creates a slight upward bias on the forward end of the yoke 10 to at least partially overcome the downward force on the pad assembly created by suction on the pad assembly during operation. This upward biasing arrangement also allows the pad assembly to ride upwardly freely as the pad encounters variations in the elevation of the floor which can cause "pinching" of the pad. This pad pinching can cause "scalping", or harsh scouring, of the floor leaving an unsightly visual appearance and can also result in an excessive load on the machine's motor.

There has thus been shown an adjustable suspension arrangement for a high speed pad driver in a rotary floor machine. The adjustable suspension arrangement allows for adjusting the height above the floor of a pad mounting plate to accommodate a range of pad thickness. As the pad mounting plate is moved vertically either upward or downward in adjusting for pad thickness, it is maintained essentially parallel to the floor throughout this displacement to ensure that a pad attached to the mounting plate engages the floor uniformly over its entire lower surface. The combination of a pivoting yoke and a ring bearing pivotally attached to the yoke through which the high speed pad driver is inserted and by means of which it is supported forms a gimbal-like structure for maintaining the pad driver assembly in a generally vertical orientation and the pad essentially horizontal, or parallel to the floor. By maintaining the rotary pad parallel to the floor, uneven pad wear is prevented and uniform pad-floor interaction over the entire lower surface of the pad is ensured.

While particular embodiments of the present invention have been shown and described, it will be obvious to those skilled in the art that changes and modifications may be made without departing from the invention in its broader aspects. Therefore, the aim in the appended claims is to cover all such changes and modifications as fall within the true spirit and scope of the invention. The matter set forth in the foregoing description and accompanying drawings is offered by way of illustration only and not as a limitation. The actual scope of the invention is intended to be defined in the following claims when viewed in their proper perspective based on the prior art.

WHAT IS CLAIMED IS:

1. For use in a high speed rotary floor machine including a housing having a plurality of wheels, a drive motor and pulley arrangement for rotating a compressible, circular pad attached to a mounting plate and having a center aperture, and a caster disposed in the center aperture of said pad in contact with the floor and pivotally coupled to said housing by means of a generally vertical, fixed shaft, wherein said mounting plate is coupled to and suspended from said pulley arrangement, apparatus for positioning the mounting plate over a range of heights above the floor to accommodate a range of pad thicknesses, said apparatus comprising: a yoke carrying said pulley arrangement, said yoke including bearing means for rotatably carrying said pulley arrangement in said yoke assembly; first coupling means for pivotally coupling a first portion of said yoke to the housing; second adjustable coupling means for coupling a second, opposed portion of said yoke to the housing and allowing for raising and lowering of said second, opposed portion of said yoke and pivoting displacement of said first portion of said yoke in changing the height of the pulley arrangement and mounting plate above the floor in accordance with the thickness of the pad; alignment means within said yoke disposed about the generally vertical, fixed shaft and engaging the pulley arrangement for maintaining the mounting plate and pad parallel to the floor as the height of the mounting plate above the floor is changed to maintain the pad in uniform contact with the floor over its entire lower surface.

2. The apparatus of claim 1, wherein said yoke includes first and second spaced bars extending between the first and second portions of said yoke and wherein said bearing means is disposed intermediate and carried by said first and second spaced bars.

3. The apparatus of claim 2, wherein said alignment means couples said bearing means to said two yoke bars and allows for pivoting displacement of said bearing means relative to said bars about a horizontal axis.

4. The apparatus of claim 3, wherein said bearing means includes a ring bearing disposed about and engaging the pulley arrangement.

5. The apparatus of claim 3, wherein said alignment means includes a pivot coupling between said bearing means and said spaced bars to allow for pivoting displacement of said bearing means about a first axis generally perpendicular to a second pivot axis of said yoke at said first coupling means.

6. The apparatus of claim 1, wherein said yoke is pivotally displaced about a first pivot axis through said first coupling means and said alignment means includes a gimbal structure to allow for pivoting displacement of the pulley arrangement and mounting plate relative to said yoke about a second pivot axis, and wherein said first and second axes are generally transverse.

7. The apparatus of claim 1 further comprising a spline connection coupling the pulley arrangement to said mounting plate.

8. The apparatus of claim 1, wherein said second adjustable coupling means includes a manually rotatable threaded member threadably engaging said yoke.

9. The apparatus of claim 1, wherein said second adjustable coupling means includes a manually rotatable threaded member threadably engaging the housing and including damping means for reducing vertical displacement of the pad during operation.

10. The apparatus of claim 9, wherein said damping means comprises a coiled spring disposed about said threaded member.

11. A high speed rotary floor machine including a pad, a motor for rotationally displacing said pad, a housing with wheels, and a caster centrally disposed relative to said rotating pad and coupled to a generally vertical tube in said housing for providing support therefor, the improvement comprising: a drive pulley coupled to and rotationally displaced by said motor, wherein said drive pulley is disposed about and coupled to said generally vertical tube by means of bearings; a casting coupled to said drive pulley by means of a spline coupler and further coupled to said pad such that said casting and pad rotate with said drive pulley; a yoke disposed about the vertical tube and pivotally coupled to said housing at a first pivot point; manual adjustment means coupled to said housing and to said yoke at a second point for pivotally displacing said yoke, drive pulley and casting about said first pivot point in permitting adjustment of vertical displacement of said casting above the floor to accommodate pads of different thicknesses, wherein said first and second points are disposed in a spaced manner on opposed sides of said generally vertical tube and wherein said first pivot point has associated therewith a first generally horizontal pivot axis; and alignment means engaging and supporting said casting and pivotally coupled to said yoke to allow for pivoting displacement of said casting about a horizontal axis when the height of said casting is adjusted about said first pivot point to maintain the orientation of said casting unchanged relative to the floor and ensure that the entire lower surface of the pad is in uniform contact with the floor.

12. The high speed rotary floor machine of claim 11 further including a generally flat plate coupled to said casting for engaging and supporting the pad.

13. The high speed rotary floor machine of claim 11, wherein said alignment means includes bearing means for facilitating rotational displacement of said casting and said drive pulley within said yoke.

14. The high speed rotary floor machine of claim 13, wherein said bearing means include a ring bearing having an inner race engaging said casting and said drive pulley and an outer race pivotally coupled to said yoke about a second generally horizontal pivot axis.

15. The high speed rotary floor machine of claim 14, wherein said first and second pivot axes are generally parallel.

16. The high speed rotary floor machine of claim 11, wherein said manual adjustment means includes a threaded pin coupled between said yoke and said housing.

17. The high speed rotary floor machine of claim 16, wherein said manual adjustment means further includes biasing means for urging said yoke and pad in an upward direction to limit pressure between the floor and said pad at elevated locations in the floor.

* * * * *